US009655216B2

(12) United States Patent
Murakami et al.

(10) Patent No.: US 9,655,216 B2
(45) Date of Patent: May 16, 2017

(54) LUMINAIRE AND ILLUMINATION SYSTEM

(71) Applicant: Panasonic Intellectual Property Management Co., Ltd., Osaka (JP)

(72) Inventors: Yoshinobu Murakami, Osaka (JP); Atsuo Nanahara, Kyoto (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 15/188,252

(22) Filed: Jun. 21, 2016

(65) Prior Publication Data

US 2016/0381769 A1 Dec. 29, 2016

(30) Foreign Application Priority Data

Jun. 25, 2015 (JP) ..... 2015-128150

(51) Int. Cl.
*H05B 37/02* (2006.01)
*G08C 23/04* (2006.01)
*G08C 17/02* (2006.01)

(52) U.S. Cl.
CPC ..... *H05B 37/0272* (2013.01); *G08C 17/02* (2013.01); *G08C 23/04* (2013.01)

(58) Field of Classification Search
CPC ..... H05B 37/0272
USPC ..... 315/291, 292
See application file for complete search history.

(56) References Cited

U.S. PATENT DOCUMENTS

2013/0241439 A1* 9/2013 Nishigaki ..... H05B 37/02 315/297
2016/0077599 A1* 3/2016 Knibbe ..... G01S 5/14 345/156

FOREIGN PATENT DOCUMENTS

JP 2005-285598 10/2005
JP 2012-089277 5/2012

* cited by examiner

*Primary Examiner* — Thuy Vinh Tran
(74) *Attorney, Agent, or Firm* — Renner, Otto, Boisselle & Sklar, LLP

(57) ABSTRACT

A luminaire includes a light source; a wireless communication circuit for communicating with a dimming controller; a storage which stores an identifier of the dimming controller; and a control circuit for dimming light of the light source according to a dimming command transmitted from the dimming coat roller when the luminaire is in a paired state, i.e., a state in which the identifier of the dimming controller is stored in the storage of the luminaire. When the control circuit is in a communication check mode, i.e., a mode for checking whether or not the luminaire is able to communicate with the dimming controller, the control circuit, regardless of whether or not the luminaire is in the paired state with the dimming controller, brings the luminaire into a predetermined illumination state by dimming light of the light source when the wireless communication circuit receives a communication cheek command from the dimming controller.

5 Claims, 4 Drawing Sheets

LUMINAIRE AND ILLUMINATION SYSTEM

CROSS REFERENCE TO RELATED APPLICATION

This application claims the benefit of priority of Japanese Patent Application Number 2015-128150 filed on Jun. 25, 2015, the entire content of which is hereby incorporated by reference.

BACKGROUND

1. Technical Field

The present disclosure relates to luminaires and illumination systems, and relates in particular to a luminaire and an illumination system which change illumination state according to a dimming command transmitted on radio waves from a dimming controller.

2. Description of the Related Art

A luminaire which changes illumination state according to a dimming command transmitted on radio waves from a dimming controller (or a radio wave remote control) has conventionally been proposed (see Patent Literature 1 (PTL 1): Japanese Unexamined Patent Application Publication Mo. 2012-89277; for example)

According to the technique of PTL 1, a luminaire changes state to a pairing standby state when the luminaire receives a pairing start request signal transmitted from a radio wave transmission unit of a radio wave remote control to start pairing up of the radio wave remote control and the luminaire (communication connection processing of storing the ID of the radio wave remote control in the luminaire). Furthermore, the luminaire cancels the pairing standby state when the luminaire receives a pairing cancellation request signal transmitted from an infrared ray transmission unit of the radio wave remote control. With this, luminaires installed within the reach of radio waves from the radio wave remote control are determined as provisional pairing partners, and desired luminaires can be excluded from the luminaires determined as provisional pairing partners. This facilitates the pairing up of the radio wave remote control and a luminaire.

SUMMARY

The technique of PTL 1, however, has a problem that the pairing operation is difficult in an environment where a large number of luminaires are installed. With the technique of PTL 1, all the luminaires installed within the reach of radio waves from the radio wave remote control react as pairing partners. For this reason, even an unintended luminaire and the like installed in a space (a floor, a room, or a building) different from the space in which the radio wave remote control is installed reacts at the time of pairing. This results in the unintended luminaire being included in the pairing partners, and the pairing operation becomes complicated.

Furthermore, with the technique of PTL 1, when a luminaire stops responding to the radio waves from the radio wave remote control for some reason, it is difficult to determine whether it is because the pairing has failed or because the radio waves from the radio wave remote control are not reaching the luminaire. It therefore requires a large amount of time for investigating the cause of malfunction and for recovery, thereby increasing the time required for the pairing.

In view of this, it is an object of the present disclosure to provide a luminaire and an illumination system which enable reliable pairing with an intended luminaire even in an environment where a large number of luminaires are installed.

To achieve the above object, a luminaire according to an aspect of the present disclosure is a luminaire which changes illumination state according to a dimming command transmitted on radio waves from a dimming controller, the luminaire including: a light source; a wireless communication circuit configured to communicate with the dimming controller; a storage which stores an identifier of the dimming controller; and a control circuit configured to, when the wireless communication circuit receives, while the luminaire is in a paired state with the dimming controller, the dimming command transmitted from the dimming controller, dim light of the light source according to the dimming command received, the paired state being a state in which the identifier of the dimming controller is stored in the storage of the luminaire, wherein the control circuit includes a communication check mode for checking whether or not the luminaire is able to communicate with the dimming controller, and in the communication check mode, the control circuit is further configured to, regardless of whether or not the luminaire is in the paired state with the dimming controller, bring the luminaire into a predetermined illumination state by dimming the light of the light source when the wireless communication circuit receives a communication check command which is for checking communication between the luminaire and the dimming controller and is transmitted from the dimming controller.

Furthermore, an illumination system according to an aspect of the present disclosure is an illumination system including: the above-described luminaire; a dimming controller configured to transmit, to the luminaire on radio waves, the dimming command for changing illumination state of the luminaire; and a manipulation controller configured to transmit, to the luminaire on infrared rays, the command which instructs transition to a communication check mode for checking whether or not the luminaire is able to communicate with the dimming controller.

The luminaire and the illumination system according to an aspect of the present disclosure enable reliable pairing with an intended luminaire even in an environment where a large number of luminaires are installed.

BRIEF DESCRIPTION OF DRAWINGS

The figures depict one or more implementations in accordance with the present teaching, by way of examples only, not by way of limitations. In the figures, like reference numerals refer to the same or similar elements.

DETAILED DESCRIPTION OF THE EMBODIMENT

Hereinafter, an embodiment of the present disclosure will be described in detail with accompanying drawings. It is to be noted that the embodiment described below to show a preferable specific example of the present disclosure. The numerical values, shapes, materials, structural elements, the arrangement and connection of the structural elements, steps, the processing order of the steps etc., shown in the following embodiment are mere examples, and are therefore not intended to limit the present disclosure. Furthermore, among the structural elements in the following embodiment, structural elements not recited in any one of the independent claims representing the most generic concepts of the present disclosure are described as arbitrary structural elements of a more preferable embodiment.

Figure 1:
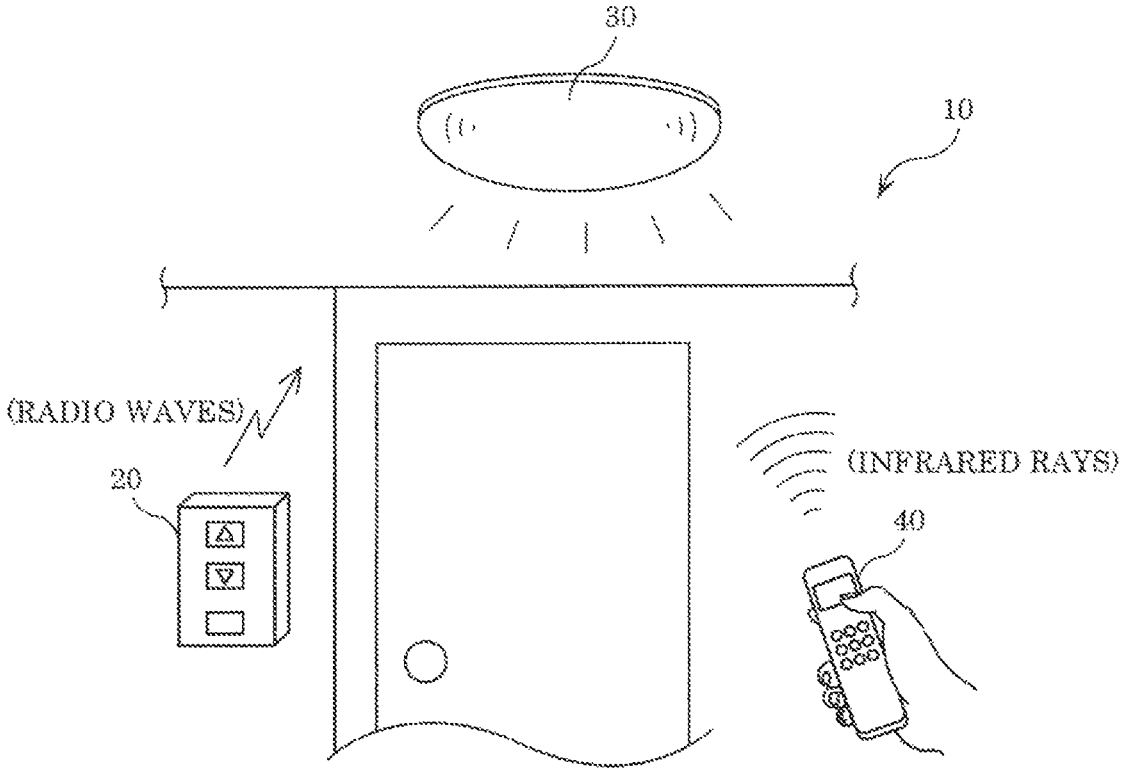
FIG. 1 is an external view illustrating a configuration of an illumination system according to an embodiment.

FIG. 1 is an external view illustrating a configuration of illumination system 10 according to an embodiment. Illumination system 10 is a system which provides dimmable illumination light, and includes dimming controller 20, luminaire 30, and manipulation controller 40. Although FIG. 1 illustrates only one luminaire 30, other luminaire may be installed in the same or different space.

Dimming controller 20 is a console (radio wave remote control) which transmits, to luminaire 30 on radio waves, a dimming command for changing illumination state of luminaire 30, and is fixed to a wall of a room, for example.

Manipulation controller 40 is a console (infrared ray remote control) which transmits, to luminaire 30 on infrared rays, a command for making various settings, and is a mobile terminal, for example.

Luminaire 30 is equipment which changes illumination state according to the dimming command transmitted on radio waves from dimming controller 20, and is a light-emitting diode (LED) apparatus, for example.

It is to be noted that when illumination system 10 includes a plurality of luminaires 30, a plurality of manipulation controllers 40 may be provided to correspond one-to-one with the plurality of luminaires, or a single common manipulation controller 40 may be provided.

Figure 2:
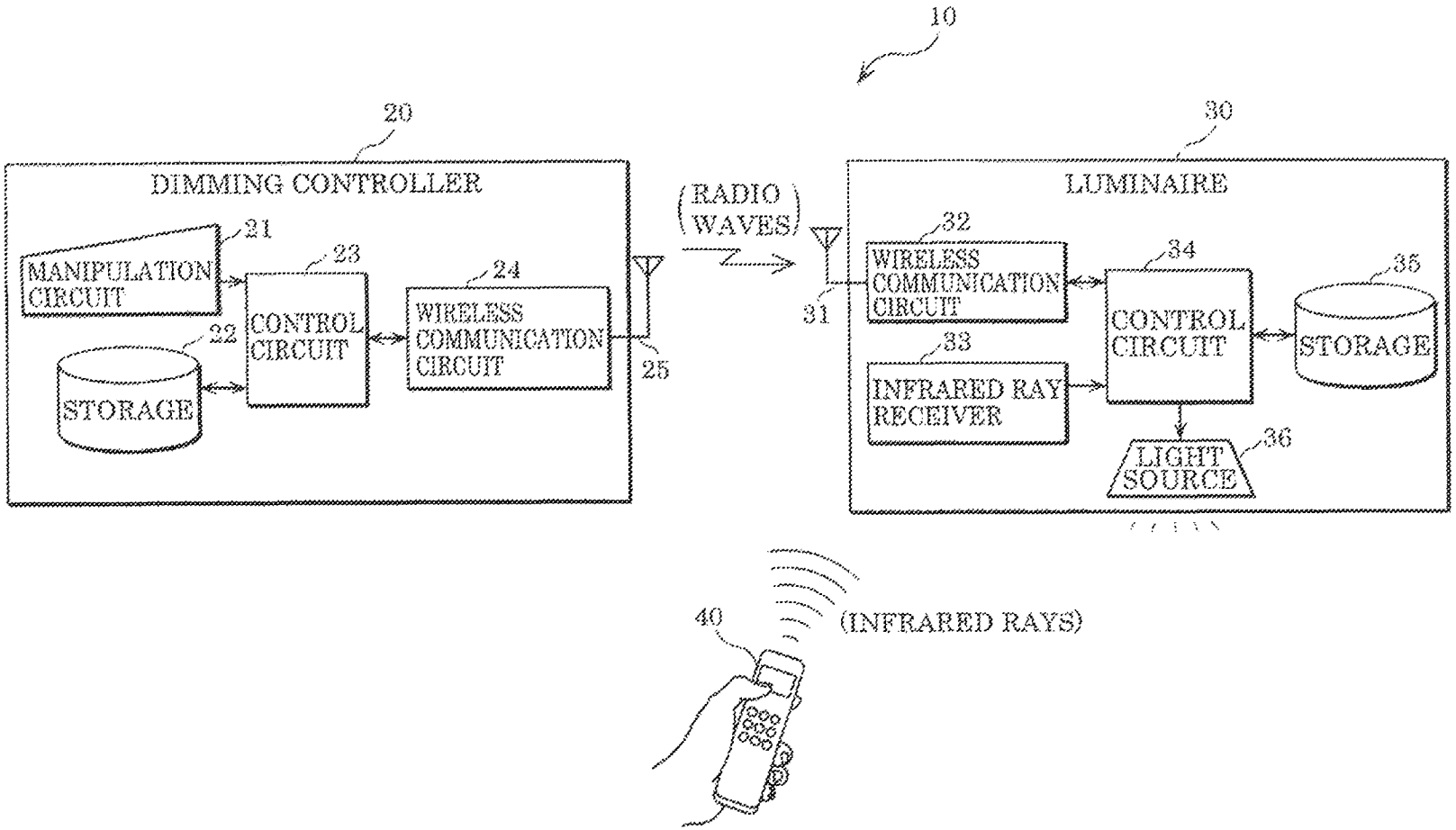
FIG. 2 is a block diagram illustrating configurations of a dimming controller and a luminaire illustrated in FIG. 1.

FIG. 2 is a block diagram illustrating configurations of dimming controller 20 and luminaire 30 illustrated in FIG. 1.

Dimming controller 20 includes manipulation unit 21, storage 22, control circuit 23, and wireless communication circuit 24.

Manipulation unit 21 is an input device which receives a manipulation instruction for dimming controller 20, and is, for example, a button for increasing a dimming level, a button for decreasing the dimming level, and a setup button for making various settings.

Storage 22 is a nonvolatile storage device which stores various data such as a control program, pairing information (the identifier of a luminaire to fee controlled), and the current dimming level, and is an electrically erasable programmable read-only memory (EEPROM), for example.

Wireless communication circuit 24 is a communication interface which communicates with luminaire 30 on radio waves via antenna 25, and is a weak power wireless module, for example.

Control circuit 23 is a control circuit which performs control to dim light of luminaire 30 by transmitting a dimming command to luminaire 30 via wireless communication circuit 24. Control circuit 23 is, for example, a one-chip microcomputer including a processor which runs the control program stored in storage 22, a random-access memory (RAM), and an input/output port (not shown), for example.

Control circuit 23 transmits not only a dimming command to luminaire 30 according to a manipulation instruction (dimming instruction) received by manipulation unit 21 but also a communication check command to luminaire 30 according to a manipulation instruction received by manipulation unit 21. The communication check command is a command for determining whether or not the radio waves from dimming controller 20 are reaching luminaire 30 (whether or not dimming controller 20 and luminaire 30 are able to perform wireless communication). In the present embodiment, the communication cheek command includes a plurality of command sets each having a dimming command for causing luminaire 30 to illuminate at a first brightness and a dimming command fox causing luminaire 30 to illuminate at a second brightness lower than the first brightness (for example, repetition of a certain time period).

Furthermore, control circuit 23 periodically transmits the identifier of dimming controller 20 via wireless communication circuit 24 when a pairing start manipulation is performed on manipulation unit 21 (for example, a manipulation of holding down the setup button for 5 seconds or longer). Control circuit 23 finishes the transmission of the identifier of dimming controller 20 when a pairing completion manipulation formed on manipulation unit 21 (for example, a manipulation of holding down the setup button for 5 seconds or longer again).

It is to be noted that dimming controller 20 may further include a display unit including an LED (not shown), for example. The display unit may present a display corresponding to the current dimming level or a display corresponding to a manipulation on manipulation unit 21, under the control of control circuit 23.

Luminaire 30 includes antenna 31, wireless communication circuit 32, infrared ray receiver 33, control circuit 34, storage 35, and light source 36.

Wireless communication circuit 32 is a communication interface which communicates with dimming controller 20 on radio waves via antenna 31, and is a weak power wireless module, for example.

Infrared ray receiver 33 is a communication interlace which receives a command transmitted from manipulation controller 40 on infrared rays, and is an infrared receiver, for example.

Storage 35 is a storage device for storing various data including the identifier of dimming controller 20, and is an EEPROM, for example.

Light source 36 is a light source which emits illumination light under the control of control circuit 34, and includes a dimming circuit and an LED (not shown), for example.

Control circuit 34 is a control circuit which controls light source 36 according to the dimming command received from dimming controller 20 via wireless communication circuit 32 and a command received from manipulation controller 40 via infrared ray receiver 33. Control circuit 34 is, for example, a one-chip microcomputer including a read-only memory (ROM) which holds a control program, a processor which runs the control program, a RAM, and an input/output port (not shown), for example.

Figure 3:
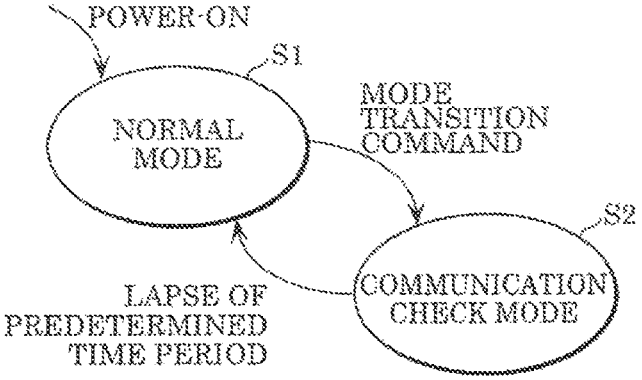
FIG. 3 is a state transition diagram related to operation modes of a control circuit of a luminaire illustrated in FIG. 2.

Control circuit 34 includes a normal mode and a communication check mode each of which is an operation mode alternative to the other. FIG. 3 illustrates a state transition diagram related to the operation modes of control circuit 34. Here, a state transition diagram including normal mode S1 and communication check mode S2 is illustrated.

Normal mode S1 basically includes: an operation mode in which luminaire 30 is in a paired state and control circuit 34 dims light of the light source according to a dimming command transmitted from dimming controller 20; and the initial state in which factory-default, unpaired luminaire 30 is powered on. In normal mode S1, when wireless communication circuit 32 receives, while luminaire 30 is in the paired state with dimming controller 20, a dimming command transmitted from dimming controller 20, control circuit 34 dims the light of light source 36 according to the dimming command received. Here, the paired state is a state in which the identifier of dimming controller 20 is stored in storage 35 of luminaire 30. That is to say, control circuit 34 dims the light of light source 36 according to the dimming command transmitted from dimming controller 20 identified by the identifier stored in storage 35 of luminaire 30, on the condition that the pairing with dimming controller 20 has been completed. In an unpaired state, luminaire 30 cannot be operated by dimming controller 20, and can be operated only by manipulation controller 40, which is an infrared controller.

The processing for the pairing is performed in normal mode S1. More specifically, control circuit 34 stores the identifier of dimming controller 20 in storage 35 when it was possible to communicate with dimming controller 20 through a predetermined procedure. For example, the pairing is performed through the following procedure. That is, when luminaire 30 is powered on, control circuit 34 causes light source 36 to illuminate at full illumination (maximum brightness) when control circuit 34 checks that no identifier is stored in storage 35 (that luminaire 30 is in the unpaired state). Subsequently, the pairing start manipulation is performed with dimming controller 20, and the identifier of dimming controller 20 is transmitted to luminaire 30 from dimming controller 20. In response to an instruction from manipulation controller 40, control circuit 34 which has received the identifier of dimming controller 20 via wireless communication circuit 32 causes light source 36 to illuminate at the lower dimming limit (the minimum brightness achievable by dimming) after storing in storage 35 the identifier of dimming controller 20 received from dimming controller 20. The pairing is completed with such a procedure.

In contrast, communication check mode S2 is an operation, mode for a manipulator to check whether or not luminaire 30 is able to communicate with dimming controller 20. Control circuit 34 transitions from normal mode S1 to communication chock mode S2 when infrared ray receiver 33 receives, while control circuit 34 is in normal mode S1, a mode transition command which instructs transition to communication check mode S2 and is transmitted from manipulation controller 40. In communication check mode S2, control circuit 34 per forms the following processing regardless of whether or not luminaire 30 is in the paired state with dimming controller 20. That is, control circuit 34 brings luminaire 30 into a predetermined illumination state by dimming the light of light source 36 when wireless communication circuit 32 receives the communication check command transmitted from dimming controller 20 for checking communication between luminaire 30 and dimming controller 20. Here, the predetermined illumination state is, for example, a state in which luminaire 30 alternately repeats a state of illuminating at the first brightness and a state of illuminating at the second brightness lower than the first brightness.

In the present embodiment, the communication check command transmitted from dimming controller 20 includes a plurality of command sets each having a dimming command for causing luminaire 30 to illuminate at the first brightness and a dimming command for causing luminaire 30 to illuminate at the second brightness. Thus, in communication check mode S2, control circuit 34 which has received such a communication check command controls light source 36 to bring luminaire 30 into the predetermined illumination state in which luminaire 30 alternately repeats the state of illuminating at the first brightness and the state of illuminating at the second brightness lower than the first brightness. Here, the first brightness is foil illumination, for example, whereas the second brightness is the lower dimming limit, for example.

With such an operation of luminaire 30 in communication check mode S2, it is possible, regardless of whether or not the luminaire is in the paired state with dimming controller 20, to determine whether or not the radio waves from dimming controller 20 are reaching the luminaire which manipulation controller 40 has caused to transition to communication check mode S2. More specifically, if the luminaire which has been caused to transition to communication check mode S2 enters the predetermined illumination state, it can be determined that the radio waves from dimming controller 20 are reaching the luminaire. On the other hand, if the luminaire which has been caused to transition to communication check mode S2 does not enter the predetermined illumination state, it can be determined that the radio waves from dimming controller 20 are not reaching the luminaire.

When the pairing is to be performed, such a communication check is performed first, and then the pairing is performed only with a luminaire for which it has been checked that the radio waves from dimming controller 20 are certainly reaching. This way, pairing with an unintended luminaire can be prevented. It is also possible to prevent unstable pairing with a luminaire installed at a position hard for the radio waves from dimming controller 20 to reach. Thus, reliable pairing can be achieved.

Furthermore, even when a situation arises where the luminaire does not respond to a manipulation performed on dimming controller 20, it is possible to at least determine whether or not the radio waves from dimming controller 20 are reaching the luminaire. It is thus possible to reduce the time necessary for investigating the cause of malfunction and for recovery, thereby reducing the time necessary for the pairing operation.

It is to be noted that when a predetermined time period (for example, 1 minute after the transition is made to communication check mode S2) elapses in communication check mode S2, control circuit 34 transitions from communication check mode S2 to normal mode S1.

Next, an operation of illumination system 10 according to the present embodiment having the above-described configuration will be described.

Figure 4:
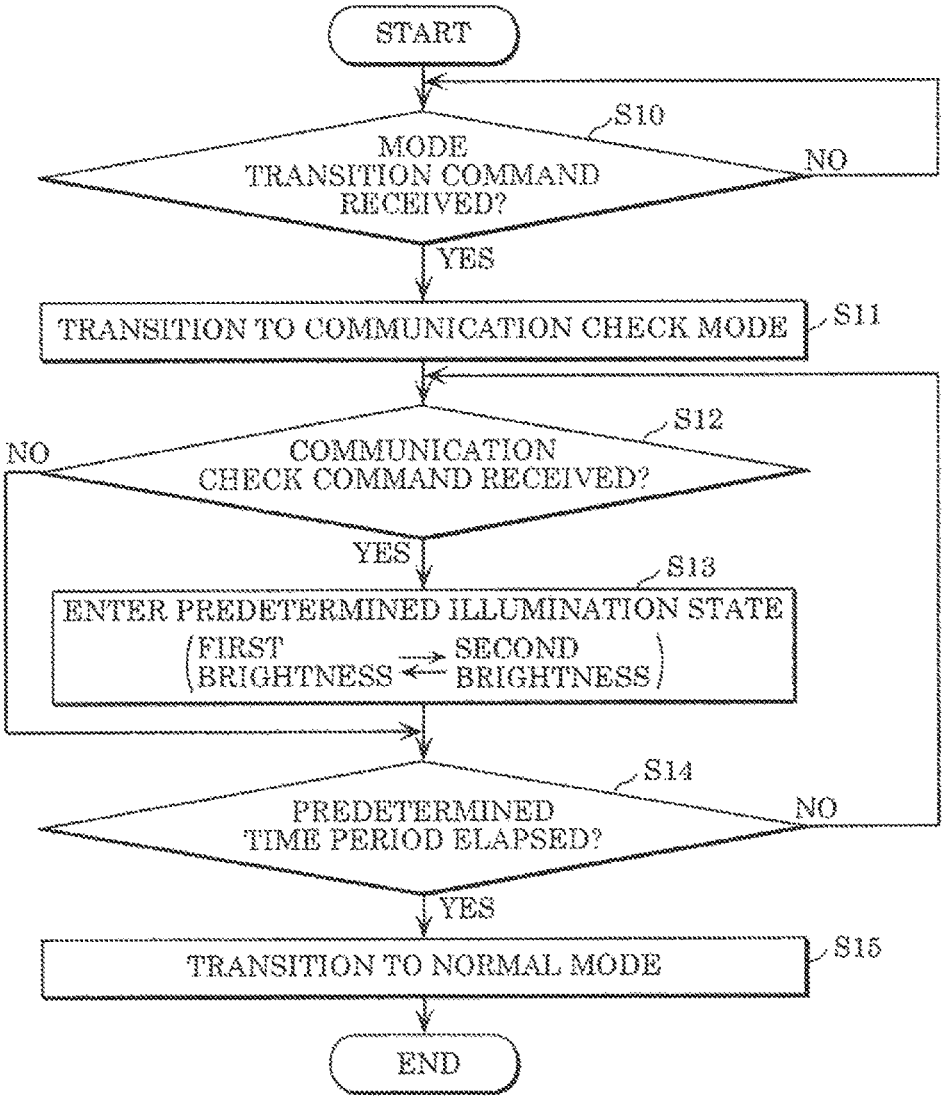
FIG. 4 is a flow chart illustrating an operation of a luminaire included in an illumination system according to an embodiment.

FIG. 4 is a flow chart illustrating an operation of luminaire 30 included in illumination system 10 according to the present embodiment. It is assumed that control circuit 34 of luminaire 30 is currently in normal mode S1. In this state, control circuit 34 monitors whether or not any one of wireless communication circuit 32 and infrared ray receiver 33 has received a command (S10). This monitoring includes monitoring of whether or not infrared ray receiver 33 has received the mode transition command which instructs transition to communication check mode S2 and is transmitted, from manipulation controller 40. In FIG. 4, Step S10 is illustrated focusing on the monitoring of the mode transition command which instructs transition to communication check mode S2.

When infrared ray receiver 33 receives the mode transition command which instructs transition to communication check mode S2 (YES in S10), control circuit 34 detects the reception of the mode transition command and transitions from normal mode S1 to communication check mode S2

(S11). At this time, control circuit 34 starts its built-in timer to enable reference to an elapsed time, period later on.

Control circuit 34 which has transitioned to communication check mode S2 monitors whether or not wireless communication circuit 32 has received the communication check command transmitted from dimming controller 20 (S12). If wireless communication circuit 32 has received the communication check command (YES in S12) control circuit 34 which has detected the reception of the communication check command brings luminaire 30 into a predetermined illumination state by dimming the light of light source 36 (S13). The predetermined illumination state is, for example, a state in which luminaire 30 alternately repeats a state of illuminating at the first brightness and a state of illuminating at the second brightness lower than the first brightness. On the other hand, if wireless communication circuit 32 has not received the communication check command (NO in S12), control circuit 34 does not perform the processing of S13.

Subsequently, control circuit 34 refers to its built-in timer to determine whether or not a predetermined time period has elapsed since the transition to communication check mode S2 (S14). If control circuit 34 determines that the predetermined time period has elapsed (YES in S14), control circuit 34 transitions from communication check mode 32 to normal mode S1 (S15). On the other hand, if control circuit 34 determines, that the predetermined time period has not elapsed (NO in S14), control circuit 34 repeats the processing of Steps S12 to S13.

Figure 5:
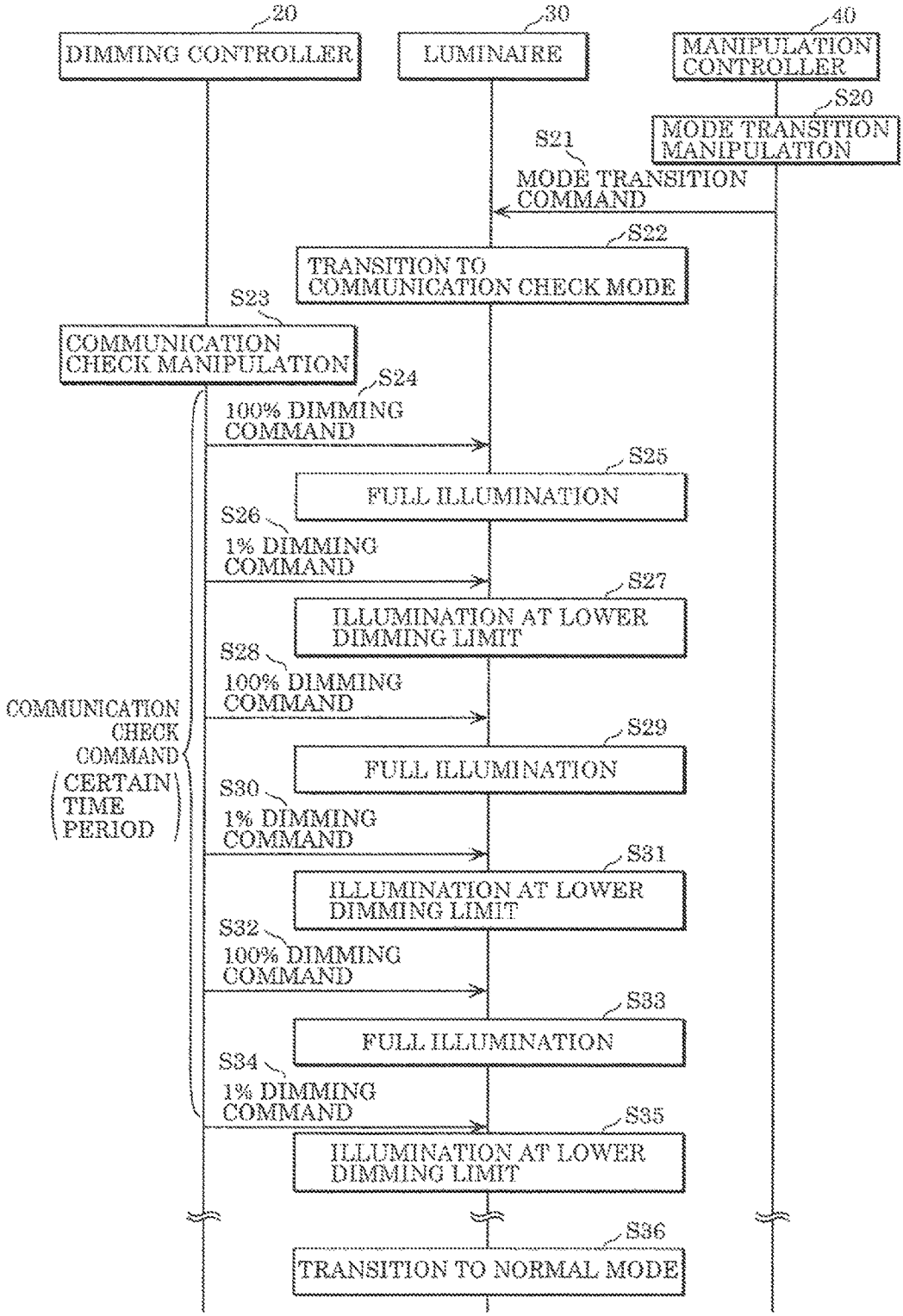
FIG. 5 is a communication sequence diagram illustrating communication among a dimming controller, a luminaire, and a manipulation controller which are included in an illumination system according to an embodiment.

FIG. 5 is a communication sequence diagram illustrating communication among dimming controller 20, luminaire 30, and manipulation controller 40 which are included in illumination system 10 according to the present embodiment. When a manipulation for instructing transition to communication check mode S2 is performed using manipulation controller 40 (S20), manipulation controller 40 transmits to luminaire 30 the mode transition command which instructs transition to communication check mode S2 (S21).

In luminaire 30 which has received the mode transition command, control circuit 34 transitions from normal mode S1 to communication check mode S2 (S22) and waits to receive the communication check command transmitted from dimming controller 20. At this time, control circuit 34 starts its built-in timer to enable reference to an elapsed time period later on.

As for dimming controller 20, it is assumed that a manipulation for instructing a communication check has been performed, using manipulation unit 21 (for example, a manipulation of pressing 3 times the setting button included in manipulation unit 21) (S23). Then, control circuit 23 which has detected this manipulation transmits the communication check command to luminaire 30 for a certain time period (for example, 3 seconds) (S24, S26, S28, S30, S32, and S34). The communication check command includes a plurality of command sets each having a dimming command for causing luminaire 30 to illuminate at the first brightness and a dimming command for causing luminaire 30 to illuminate at the second brightness lower than the first brightness. Here, the dimming command for causing luminaire 30 to illuminate at the first brightness is a command for causing luminaire 30 to illuminate at the full illumination ("100% dimming command") (S24, S28, and S32). The dimming command for causing luminaire 30 to illuminate at the second brightness is a command for causing luminaire 30 to illuminate at the lower dimming limit ("1% dimming command") (S26, S30, and S34). Such two types of dimming commands are alternately repeated and transmitted from dimming controller 20 to luminaire 30 as the communication check command.

When luminaire 30 in communication check mode S2 receives the dimming command for causing luminaire 30 to illuminate at the first brightness ("100% dimming command"), control circuit 34 dims the light of light source 36 to the first brightness (full illumination) according to the dimming command received (S25, S29, and S33). On the other hand, when luminaire 30 receives the dimming command for causing luminaire 30 to illuminate at the second brightness ("1% dimming command"), control circuit 34 dims the light of light source 36 to the second brightness (illumination at the lower dimming limit) according to the dimming command received (S27, S31, and S35). In such a manner as described above, luminaire 30 alternately repeats the state in which luminaire 30 illuminates at the first brightness (here, full illumination) and the state in which luminaire 30 illuminates at the second brightness (here, illumination at the lower dimming limit) lower than the first brightness.

When control circuit 34 detects, by referring to its built-in timer, that a predetermined time period (for example, 1 minute) has elapsed since the transition to communication check mode S2, control circuit 34 transitions from communication check mode S2 to normal mode S1 (S36).

As described above, luminaire 30 included in illumination system 10 of the present embodiment is luminaire 30 which changes illumination state according to a dimming command transmitted on radio waves from dimming controller 20, and includes light source 36, wireless communication circuit 32, storage 35, and control circuit 34. Wireless communication circuit 32 communicates with dimming controller 20. Storage 35 stores the identifier of dimming controller 20. When wireless communication circuit receives, while luminaire 30 is in a paired state, the dimming command transmitted from dimming controller 20, control circuit 34 dims the light of light source 36 according to the dimming command received. Here, the paired state is a state in which the identifier of dimming controller 20 is stored in storage 35 of luminaire 30. Here, control circuit 34 further includes communication cheek mode S2 for chocking whether or not luminaire 30 is able to communicate with dimming controller 20. In communication check mode S2, regardless of whether or not luminaire 30 is in the paired state with dimming controller 20, control circuit 34 brings luminaire 30 into a predetermined illumination state by dimming the light of light source 36 when wireless communication circuit 32 receives the communication cheek command which is transmitted from dimming controller 20 for checking the communication between luminaire 30 and dimming controller 20.

With this, regardless of whether or not the luminaire is in the paired state with dimming controller 20, the luminaire which has transitioned to communication check mode S2 in response to the mode transition command transmitted from manipulation controller 40 enters the predetermined illumination state when the communication check command is received from dimming controller 20. This means that if the luminaire which has been caused to transition to communication check mode S2 enters the predetermined illumination state, it can be determined that the radio waves from dimming controller 20 are reaching the luminaire. On the other hand, if the luminaire which has been caused to transition to communication check mode S2 does not enter the predetermined illumination state, it can be determined that the radio waves from dimming controller 20 are not reaching the luminaire.

Thus, when the pairing is to be performed, such a communication check is performed first, and then the pairing is performed only with a luminaire for which it has been checked that the radio waves from dimming controller 20 are certainly reaching. This way, pairing with an unintended luminaire can be prevented. It is also possible to prevent unstable pairing with a luminaire installed at a position hard for the radio waves from dimming controller 20 to reach. Thus, stable dimming by dimming controller 20 is ensured.

Furthermore, even when a situation arises where the luminaire does not respond to a manipulation performed on dimming controller 20, it is possible to at least determine whether or not the radio waves from dimming controller 20 are reaching the luminaire. It is thus possible to reduce the time necessary for investigating the cause of malfunction and for recovery, thereby reducing the time necessary for the pairing operation.

Furthermore, since only the luminaire which has transitioned to communication check mode S2 becomes the subject of the communication check as to whether or not communication is possible with the dimming controller, it is possible to narrow down luminaires for which the communication cheek is desired, unlike the conventional techniques where all the luminaires installed within the reach of radio waves react. For example, only a luminaire installed on the same (or different) floor as the Boor on which the dimming controller is installed can be specified as the subject of the communication check.

Thus, with the luminaire and the illumination system according to the present embodiment, the check as to whether or not the radio waves from the dimming controller reach the luminaire and the pairing operation can be performed separately at the site where the luminaire is installed. This enables reliable pairing with an intended luminaire even in an environment where a large number of luminaires are installed.

Furthermore, in the above embodiment, luminaire 30 includes infrared ray receiver 33 which receives a command transmitted on infrared rays from manipulation controller 40. Control circuit 34 transitions to communication check mode S2 when infrared ray receiver 33 receives a mode transition command which instructs transition to communication check mode S2 and is transmitted from manipulation controller 40.

This makes it possible, with a simple manipulation using manipulation controller 40, to specify a luminaire for which the communication check is desired.

The predetermined illumination state in the above embodiment is a state in which luminaire 30 alternately repeats a state of illuminating at the first brightness and a state of illuminating at the second brightness lower than the first brightness.

With this, the result of the communication check can be visually recognized with ease because the brightness of luminaire 30 changes if the radio waves from dimming controller 20 are reaching luminaire 30.

The communication check command in the above embodiment includes a plurality of command sets each having a dimming command for causing luminaire 30 to illuminate at the first brightness and a dimming command for causing luminaire 30 to illuminate at the second brightness.

With this, luminaire 30 in the communication check mode alternately repeats the bright illumination state and the dark illumination state simply by dimming the light of light source 36 according to the dimming commands transmitted from dimming controller 20. Thus, the check state in the communication check mode can be easily achieved. Furthermore, since it is possible to visually check that the dimming commands of the plural types are reaching luminaire 30 from dimming controller 20 and are being executed by luminaire 30, the communication check can be reliably performed.

The luminaire and the illumination system according to the present disclosure have been described above based on an embodiment, but the present disclosure is not limited to this embodiment. Various modifications to this embodiment which may be conceived by those skilled in the art, as well as embodiments resulting from combinations of some of the structural elements of this embodiment are to be included within the scope of the present disclosure, as long as such modifications and embodiments do not depart from the essence of the present disclosure.

For example, although the communication check in the above embodiment is performed between one dimming controller 20 and one luminaire 30, the present disclosure is not limited to this and the communication check may be performed between one dimming controller and a plurality of luminaires or between a plurality of dimming controllers and one or more luminaries. In the case of performing the communication check between one dimming controller and a plurality of luminaires, each of the plurality of luminaires subject to the communication check is caused to transition to the communication check mode. After that, the one dimming controller broadcasts the communication check command to the plurality of luminaires. With this, it is possible to specify a plurality of luminaires and perform the communication check for the plurality of luminaires simultaneously, and thus the time necessary for the communication check can be reduced.

Furthermore, in the above embodiment, the communication check command is transmitted from dimming controller 20 after luminaire 30 is caused to transition to the communication check mode. The present disclosure, however, is not limited to this order. Luminaire 30 may be caused to transition to the communication check mode after dimming controller 20 has started transmitting the communication check command. This is because even with this order, luminaire 30 enters the predetermined illumination state in response to the communication check command as long as the communication check command is transmitted, from dimming controller 20 after luminaire 30 transitions to the communication check mode.

Furthermore, luminaire 30 in the above embodiment includes infrared ray receiver 33 and transitions to the communication check mode when infrared, ray receiver 33 receives the mode transition command transmitted from manipulation controller 40. The present disclosure, however, is not limited to this. Luminaire 30 may transition to the communication check mode when a manipulation switch or a manipulation button included in luminaire 30 is manually manipulated. Thus, luminaire 30 does not necessarily have to include infrared ray receiver 33.

Furthermore, the communication check command in the above embodiment includes a plurality of command sets each having a dimming command for causing luminaire 30 to illuminate at the first brightness and a dimming command for causing luminaire 30 to illuminate at the second brightness lower than the first brightness. The present disclosure, however, is not limited to this. The communication check command may be one command set having a dimming command for causing luminaire 30 to illuminate at the first brightness and a dimming command for causing luminaire 30 to illuminate at the second brightness, or may be only one of these dimming commands. Furthermore, the communication check command may be a dimming command for fading the brightness of luminaire 30 (gradually making the brightness higher or lower). It is sufficient as long as the communication check command is at least one dimming command for bringing luminaire 30 into a predetermined illumination state (a predetermined, visible illumination state).

Furthermore, although control circuit 34 of luminaire 30 in the above embodiment includes two operation modes (normal mode S1 and communication check mode S2), control circuit 34 may include three or more operation modes. For example, control circuit 34 may include an operation mode (maintenance mode) in which control circuit 34 dims the light of light source 36 according to various maintenance commands transmitted from manipulation controller 40.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fell within the true scope of the present teachings.

What is claimed is:

1. A luminaire which changes illumination state according to a dimming command transmitted on radio waves from a dimming controller, the luminaire comprising:

a light source;

a wireless communication circuit configured to communicate with the dimming controller;

a storage which stores an identifier of the dimming controller; and a control circuit configured to, when the wireless communication circuit receives, while the luminaire is in a paired state with the dimming controller, the dimming command transmitted from the dimming controller, dim light of the light source according to the dimming command received, the paired state being a state in which the identifier of the dimming controller is stored in the storage of the luminaire, wherein the control circuit includes a communication check mode for checking whether or not the luminaire is able to communicate with the dimming controller, and in the communication check mode, the control circuit is further configured to, regardless of whether or not the luminaire is in the paired state with the dimming controller, bring the luminaire into a predetermined illumination state by dimming the light of the light source when the wireless communication circuit receives a communication check command which is for checking communication between the luminaire and the dimming controller and is transmitted from the dimming controller.

2. The luminaire according to claim 1, further comprising an infrared ray receiver configured to receive a command transmitted on infrared rays from a manipulation controller, wherein the control circuit is configured to transition to the communication check mode when the infrared ray receiver receives a mode transition command which instructs transition to the communication check mode and is transmitted from the manipulation controller.

3. An illumination system comprising:

the luminaire according to claim 2;

a dimming controller configured to transmit, to the luminaire on radio waves, the dimming command for changing illumination state of the luminaire; and a manipulation controller configured to transmit, to the luminaire on infrared rays, the command which instructs transition to a communication check mode for checking whether or not the luminaire is able to communicate with the dimming controller.

4. The luminaire according to claim 1, wherein the predetermined illumination state is a state in which the luminaire alternately repeats a state of illuminating at a first brightness and a state of illuminating at a second brightness lower than the first brightness.

5. The luminaire according to claim 4, wherein the communication check command includes a plurality of command sets each having a dimming command for causing the luminaire to illuminate at the first brightness and a dimming command for causing the luminaire to illuminate at the second brightness.

* * * * *